US012642363B2

(12) United States Patent
Roma

(10) Patent No.: US 12,642,363 B2
(45) Date of Patent: Jun. 2, 2026

(54) RENEWABLE AND CONFIGURABLE MATTRESS

(71) Applicant: Otis Bed Manufacturing Company, Inc., Buffalo, NY (US)

(72) Inventor: John K. Roma, Orchard Park, NY (US)

(73) Assignee: Otis Bed Manufacturing Company, Inc., Buffalo, NY (US)

( * ) Notice: Subject to any disclaimer, the term of this patent is extended or adjusted under 35 U.S.C. 154(b) by 245 days.

(21) Appl. No.: 18/518,833

(22) Filed: Nov. 24, 2023

(65) Prior Publication Data

US 2025/0169616 A1 May 29, 2025

(51) Int. Cl.

| | |
|---|---|
| ***A47C 27/14*** | (2006.01) |
| ***A47C 27/05*** | (2006.01) |
| ***A47C 27/07*** | (2006.01) |

(52) U.S. Cl.

CPC ..... *A47C 27/14* (2013.01); *A47C 27/056* (2013.01); *A47C 27/07* (2013.01)

(58) Field of Classification Search

CPC ..... A47C 27/14; A47C 27/056; A47C 27/07; A47C 27/001; A47C 27/15; A47C 27/062; A47C 31/105

See application file for complete search history.

(56) References Cited

U.S. PATENT DOCUMENTS 1,528,066 A * 3/1925 Mcentire ..... A47C 27/001 5/722
3,308,490 A * 3/1967 Cacioppo ..... A47G 9/10 5/652
4,449,261 A 5/1984 Magnusson
4,955,095 A * 9/1990 Gerrick ..... A47C 31/105 5/691
5,065,485 A * 11/1991 Zocco ..... A47C 31/105 29/525.04
5,136,741 A * 8/1992 Balonick ..... A47C 27/15 5/699
5,768,726 A 6/1998 Myles
7,051,388 B1 * 5/2006 Taddeo ..... A47C 21/026 5/486
7,757,322 B2 * 7/2010 An ..... A47C 27/062 5/722
9,060,617 B2 * 6/2015 James ..... A47C 27/04
(Continued)

FOREIGN PATENT DOCUMENTS

WO 2011072022 A1 6/2011

*Primary Examiner* — Fredrick C Conley
(74) *Attorney, Agent, or Firm* — Hodgson Russ LLP

(57) ABSTRACT

A mattress system has a shell including a bottom and a peripheral wall defining a shell interior, a plurality of securement flaps attached to the peripheral wall that include a first fastener element and a second fastener element on opposite sides of each securement flap, a core assembly removably received in the shell interior, a topper including one or more foam layers, and a top cover releasably coupled to the shell for covering the shell interior and the topper. The first fastener element on each securement flap is releasably fastened to the core assembly and the second fastener element on each securement flap is releasably fastened to the topper. The core assembly may include a foam tub that receives a replaceable base layer covered by a releasably fastened tub cap or a core layer releasably fastened directly to the tub.

19 Claims, 11 Drawing Sheets

(56) References Cited

U.S. PATENT DOCUMENTS

| | | | | |
|---|---|---|---|---|
| 9,131,782 | B1 * | 9/2015 | Baker | A47C 27/001 |
| D794,981 | S | 8/2017 | Roma et al. | |
| D898,414 | S | 10/2020 | Roma et al. | |
| D898,415 | S | 10/2020 | Roma et al. | |
| 12,137,816 | B2 * | 11/2024 | Nolte | G06Q 30/0601 |
| 2006/0048304 | A1 * | 3/2006 | Boyd | A47C 27/15 5/738 |
| 2007/0067916 | A1 | 3/2007 | Poston | |
| 2008/0201856 | A1 * | 8/2008 | Howard | A47C 31/123 5/690 |
| 2008/0263774 | A1 | 10/2008 | Lee | |
| 2011/0094039 | A1 * | 4/2011 | Tervo | A47C 27/056 5/691 |
| 2020/0237108 | A1 | 7/2020 | Alletto | |

* cited by examiner

RENEWABLE AND CONFIGURABLE MATTRESS

FIELD OF THE DISCLOSURE

The present disclosure relates to mattress systems, and in particular to a renewable and configurable mattress system that is easy to manufacture, ship, assemble, customize, and renew.

BACKGROUND OF THE DISCLOSURE

Renewable mattress systems are known. In a renewable mattress system, modular portions of the system may be replaced after a period of use to renew the firmness and support properties of the mattress, thereby extending its life. For example, applicant herein discloses a renewable mattress system in International Publication No. WO 2011/072022-A1 based on a coil-spring support assembly surrounded by replaceable foam inserts.

Configurable mattress systems are also known, wherein firmness properties of the mattress may be selectively configured to meet user preferences. For example, users desiring increased firmness at a head region of the mattress compared to a foot region of the mattress may be provided with a customized mattress having the desired firmness profile.

Renewable and/or configurable mattress systems known to applicant are generally complex in structure. As a result, these mattress systems are expensive to manufacture, and are difficult to renew or reconfigure without the assistance of a mattress professional. Moreover, they are expensive to package and ship to customers.

SUMMARY OF THE DISCLOSURE

The present disclosure provides a mattress system designed for easy replacement of components to enable manufacturers and end users to renew and configure the mattress system when necessary or as desired. The mattress system of the present disclosure generally comprises a shell, a plurality of securement flaps, a core assembly, a topper, and a top cover.

The shell includes a bottom and a peripheral wall together defining a shell interior. The plurality of securement flaps are attached to the peripheral wall. Each of the plurality of securement flaps includes a free portion extendable over the shell interior, wherein the free portion has an inward side and an outward side opposite the inward side. The inward side of each securement flap has a first fastener element thereon and the outward side of each securement flap has a second fastener element thereon.

The core assembly is removably received in the shell interior. In some embodiments, the core assembly may include one or more pieces of foam, each piece of foam being individually enclosed in a respective core envelope of fire-resistant fabric. The number of foam pieces making up the core assembly may vary. In one embodiment, the core assembly includes exactly one piece of foam. In another embodiment, the core assembly includes exactly two pieces of foam, one at a head region of the shell interior and the other at a foot region of the shell interior. In yet another embodiment, the core assembly includes exactly three pieces of foam, one at a head region of the shell interior, another at a foot region of the shell interior, and a third at a middle region of the shell interior. The number of pieces of foam making up the core foam layer may be greater than three. Where the core assembly includes more than one piece of foam, the foam pieces may have different firmness and support properties to customize the comfort and support profile of the mattress for a specific user or users.

In other embodiments, the core assembly may include a resiliently deformable tub having a plurality of tub wall fastener elements on a top surface of a tub wall. In one such embodiment, a base layer is received in an interior of the tub, a resiliently deformable tub cap is received in the tub interior above the base layer, and a resiliently deformable intermediate layer may be received in the tub interior between the base layer and the tub cap. The tub cap includes a plurality of tub cap flaps each having a tub cap fastener element on a downward face thereof and a securement fastener element on an upward face thereof. The tub cap fastener element on each of the plurality of tub cap flaps releasably fastens to a respective tub wall fastener element, and the first fastener element on the inward side of each of the securement flaps releasably fastens to the securement fastener element on a respective tub cap flap.

In another such embodiment, a core layer is received in the interior of the tub. The core layer includes a plurality of core layer flaps each having a core layer fastener element on a downward face thereof and a securement fastener element on an upward face thereof. The core layer fastener element on each of the plurality of core layer flaps releasably fastens to a respective tub wall fastener element, and the first fastener element on the inward side of each of the securement flaps releasably fastens to the securement fastener element on a respective core layer flap.

In an aspect of the disclosure, the first fastener element on the inward side of each of the plurality of securement flaps is releasably fastened to the core assembly, and the second fastener element on the outward side of each of the plurality of securement flaps is releasably fastened to the topper. As may be understood, the securement flaps maintain the topper securely centered on the core assembly, while allowing the topper and core assembly to be easily removed and replaced or reconfigured.

The plurality of securement flaps may include a head securement flap attached to a head wall portion of the shell peripheral wall, a foot securement flap attached to a foot wall portion of the shell peripheral wall, and a pair of side securement flaps respectively attached to a pair of side wall portions of the shell peripheral wall.

The topper includes one or more foam layers enclosed in a topper envelope of fire-resistant fabric. The top cover is releasably coupled to the shell, for example by a zipper, for covering the shell interior and topper.

BRIEF DESCRIPTION OF THE DRAWING VIEWS

The nature and mode of operation of the present disclosure will now be more fully described in the following detailed description taken with the accompanying drawing figures, in which.

DETAILED DESCRIPTION OF THE DISCLOSURE

Figure 1:
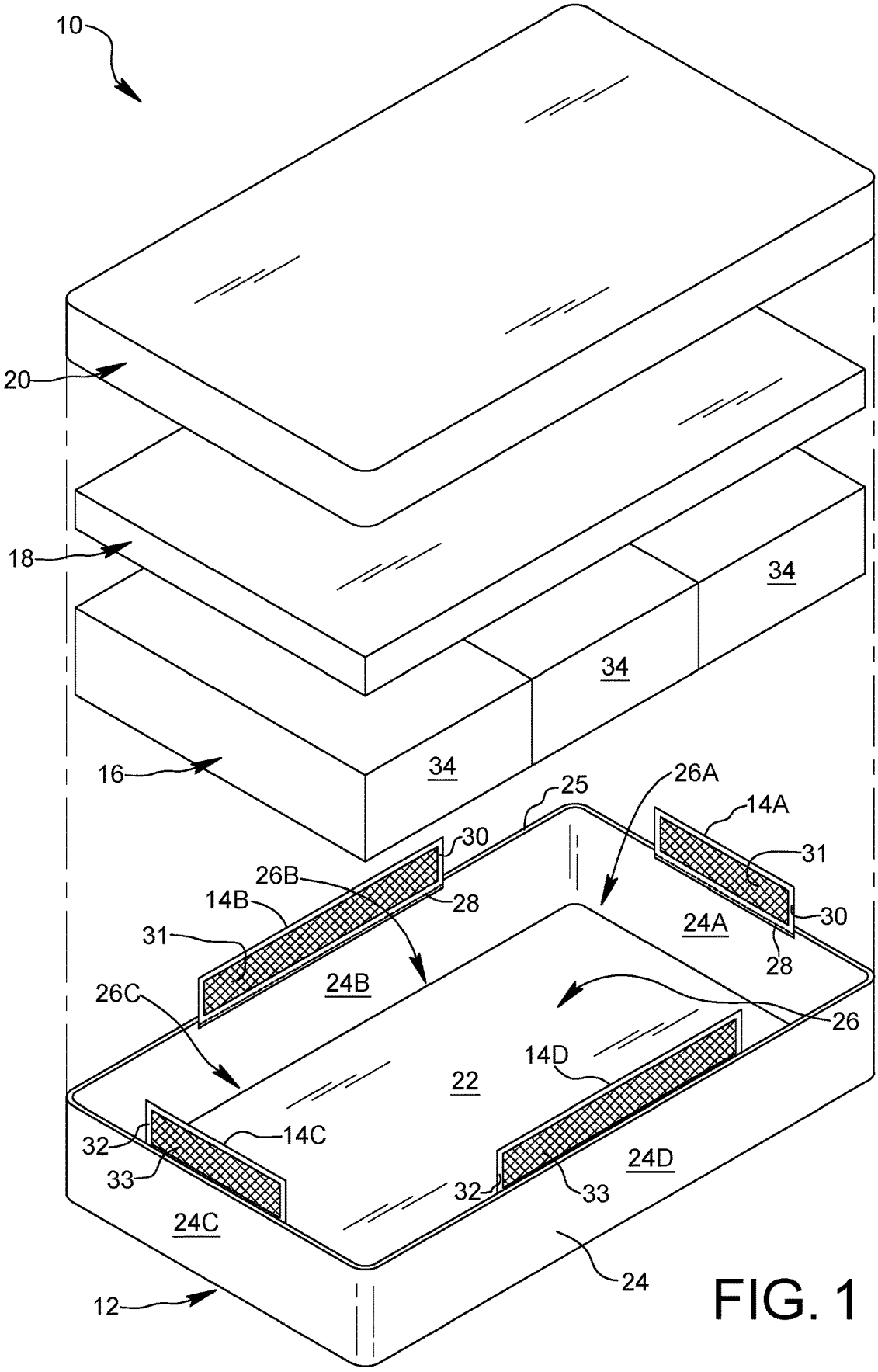
FIG. 1 is an exploded orthogonal view of a mattress system formed in accordance with a first embodiment of the present disclosure.
Figure 2:
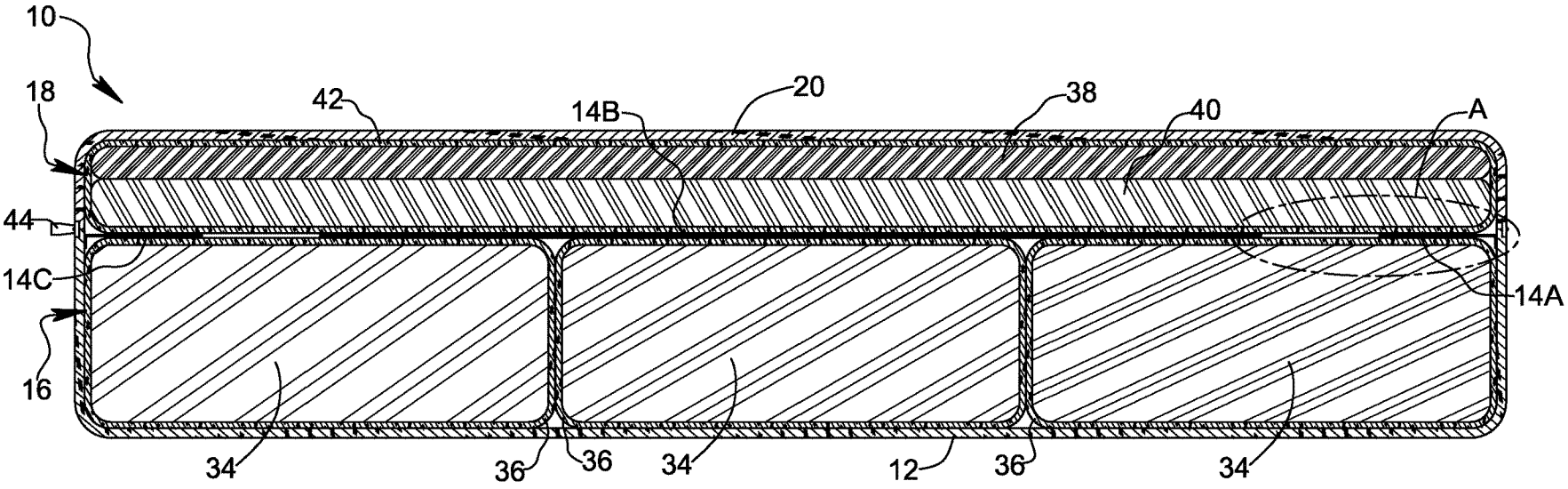
FIG. 2 is a longitudinal cross-sectional view of the mattress system shown in FIG. 1.
Figure 3:
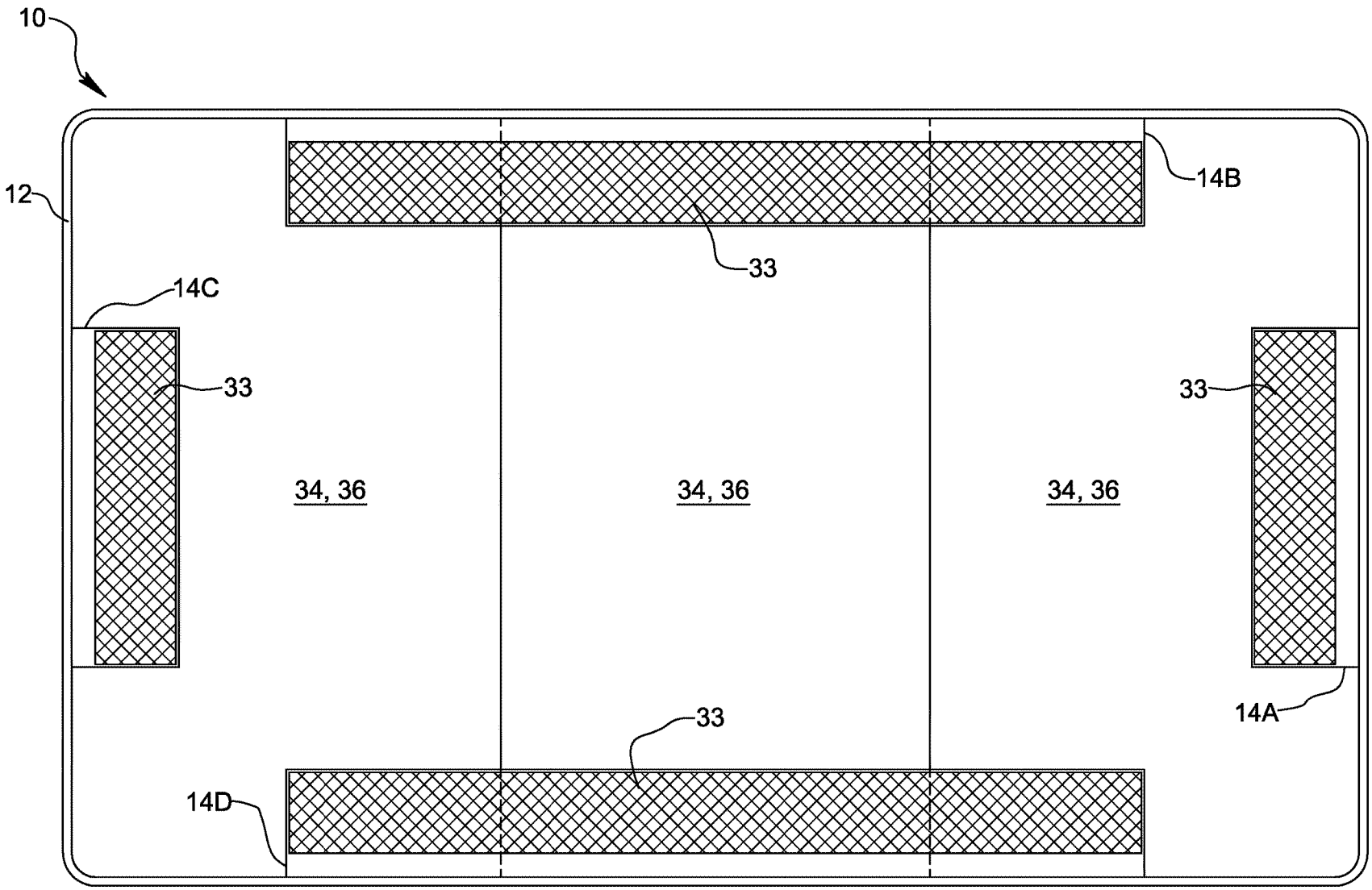
FIG. 3 is a top plan view of the mattress system shown in FIG. 1, wherein a topper and a top cover of the mattress system are omitted to reveal internal structure.

FIGS. 1-3 show a mattress system 10 formed in accordance with a first embodiment of the present disclosure. Mattress system 10 is readily renewable and configurable for enhanced sleeping comfort.

Mattress system 10 generally comprises a shell 12, a plurality of securement flaps 14A-14D, a core assembly 16, a topper 18, and a top cover 20.

Shell 12 includes a bottom 22 and a peripheral wall 24 extending upward from bottom 22 such that the bottom and peripheral wall define a shell interior 26. Shell 12 may be manufactured from a fire-resistant fabric to help ensure compliance with U.S. federal regulatory standards such as 16 C.F.R. Part 1632—Standard for the Flammability of Mattresses and Mattress Pads and 16 C.F.R. Part 1633—Standard for the Flammability (Open Flame) of Mattress Sets, as well as various state regulatory standards.

The plurality of securement flaps 14A-14D may be formed of fabric and are attached to peripheral wall 24, for example by stitching 28. Each of the plurality of securement flaps 14A-14D includes a free portion foldable to extend over shell interior 26, wherein the free portion includes an inward side 30 and an outward side 32 opposite the inward side. The inward side 30 of each securement flap has one or more first fastener elements 31 thereon and the outward side 32 has one or more second fastener elements 33 thereon. First and second fastener elements 31, 33 may be hook or loop (e.g., VELCRO®) patches affixed to the opposite sides 30, 32 of each securement flap 14A-14D by stitching and/or adhesive. In the embodiment shown, fastener elements 31, 33 are both hook fastener patches. As will be understood, fastener elements 31 and/or 33 may take alternative forms. For example, fastener elements 31 and 33 may be embodied as snap elements (male or female), buttons or buttonholes, and/or zipper elements provided on securement flaps 14A-14D. Also, the gender of mating fastener elements may be inverted (i.e., hook patches may be swapped with loop patches, male elements may be swapped with female elements) without straying from the disclosure. As used herein, the term "fastener element" is intended to broadly encompass the mentioned types, and other types of releasable fastener elements known to those skilled in the art.

Core assembly 16 is removably received in shell interior 26. Core assembly 16 may include one or more pieces of foam 34, each piece of foam 34 being individually enclosed in a respective core envelope 36 made of fire-resistant fabric. In the embodiment illustrated in FIGS. 1-3, core assembly 16 includes exactly three pieces of foam 34, one piece 34 being received at head region 26A of shell interior 26, a second piece 34 being received at a foot region 26C of shell interior 26, and a third piece of the three pieces of foam being received at a middle region 26B of shell interior 26 between head region 26A and the foot region 26C. Each piece of foam 34 may be formed of extra-firm foam, such as 2.1 pound density, 55 ILD (Indentation Load Deflection), to provide a supportive core layer for mattress system 10. Of course, foams having other density and firmness properties may be used. The use of multiple foam pieces 34 is advantageous for shipping purposes due to the smaller sized foam pieces, and allows for a customized and configurable firmness distribution over the length of mattress system 10 from head to foot. For example, the foam pieces 34 at head region 26A, middle region 26B, and foot region 26C may have different firmness properties to accommodate user preferences and/or medical treatment requirements.

Each core envelope 36 may be made from fire-resistant fabric.

Topper 18 may include one or more foam layers 38, 40 enclosed by a topper envelope 42 which may be made of knitted fire-resistant fabric. For example, layer 38 may be a foam top layer made of relatively soft foam, and layer 40 may be a foam transition layer below the foam top layer 38 made of foam that is firmer than the foam used to make top layer 38 but somewhat less firm than foam piece or pieces 34 in core assembly 16. As may be understood, the foam used in top layer 38, transition layer 40, and core assembly 16 may be chosen such that the layers exhibit increasing firmness in a direction from top to bottom.

Figure 2A:
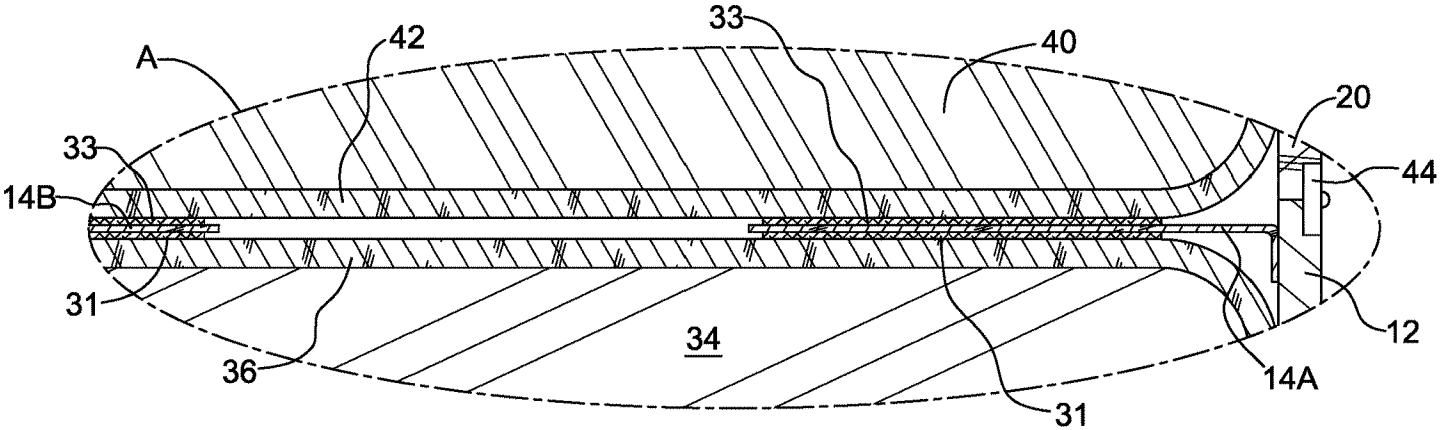
FIG. 2A is an enlarged cross-sectional view of region A in FIG. 2.

As best seen in FIGS. 2 and 2A, the first fastener element 31 on the inward side 30 of each of the plurality of securement flaps 14A-14D is releasably fastened to the core envelope 36 of at least one piece of foam 34 of core assembly 16. In the embodiment shown in FIGS. 1-3, securement flaps 14A and 14C are attached to a head wall portion 24A and a foot wall portion 24C of peripheral wall 24, respectively. Head securement flap 14A folds downward for releasable fastening of its first fastening element 31 to core envelope 36 on foam piece 34 at head region 26A, and foot securement flap 14C folds downward for releasable fastening of its first fastening element 31 to core envelope 36 on foam piece 34 at foot region 26C. Securement flaps 14B and 14D are attached to opposite side wall portions 24B and 24D of peripheral wall 24 and fold downward for releasable fastening of their associated first fastening elements 31 to core envelopes 36 on foam pieces 34 at head region 26A, middle region 26B, and foot region 26C.

In this embodiment, the core envelope 36 on each foam piece 34 of core assembly 16 is directly gripped by at least two different first fastener elements 31 embodied as hook fastener elements able to engage with the fabric of the core envelope. The core envelope 36 on the foam piece 34 at head region 26A is gripped by three different first fastener elements 31 on securement flaps 14A, 14B, and 14D, respectively. Similarly, the core envelope 36 on the foam piece 34 at foot region 26C is gripped by three different first fastener elements 31 on securement flaps 14B, 14C, and 14D, respectively. The core envelope 36 on the foam piece 34 at middle region 26B is gripped by two different first fastener elements 31 on securement flaps 14B and 14D, respectively. As illustrated in FIGS. 2 and 3, side securement flaps 14B and 14D may be elongated to overlap all three foam pieces 34 of core assembly 16, and their associated first fastener elements 31 may grip the core envelope 36 of each foam piece 34. In a variant, loop fastener elements (not shown) may be attached to each core envelope 36 for mating with first fastener elements 31. As will be understood, where first fastener elements 31 are embodied differently, for example as male snap members, then mating fastener elements, for example female snap members, must be provided on each core envelope 36 at corresponding locations.

The second fastener element 33 on the outward side 32 of each of the plurality of securement flaps 14A-14D is releasably fastened to an underside of topper envelope 42 of topper 18. In the illustrated embodiment, second fastener elements 33 are embodied as hook fastener elements able to directly grip the fabric of topper envelope 42. In a variant, loop fastener elements (not shown) may be attached to the underside of topper envelope 42 for mating with second fastener elements 33. As may be seen in FIG. 2A, securement flaps 14A-14D are sandwiched between and attached to core assembly 16 and topper 18, and act to keep topper 18 properly positioned on core assembly 16 during use. As will be understood, where second fastener elements 31 are embodied differently, for example as male snap members, then mating fastener elements, for example female snap members, must be provided on each core envelope 36 at corresponding locations.

Top cover 20 may be releasably coupled to shell 12 for covering shell interior 26 and topper 18 while allowing access to shell interior 26 as desired. For example, top cover 20 may be dimensioned to fit over topper 18 and extend downward such that its bottom periphery is adjacent to the top periphery of shell 12, and a zipper 44 may be arranged to releasably couple the peripheries of top cover 20 and shell 12. Zipper 44 may extend completely around or almost completely around the coupled peripheries of shell 12 and top cover 20. If zipper 44 does not extend completely around the coupled peripheries, then a relatively short segment of top cover 20 may be permanently sewn to a peripheral wall 24 of shell 12 and the remaining periphery of top cover 20 may be coupled to shell 12 by zipper 44. In the embodiment shown in FIGS. 1-3, zipper 44 is located along a top peripheral edge 25 of peripheral wall 24. However, zipper 44 may be located some distance below top peripheral edge 25, and top cover 20 may be sized to overlap with an upper region of peripheral wall 24 when the top cover is releasably coupled to shell 12.

Figure 4:
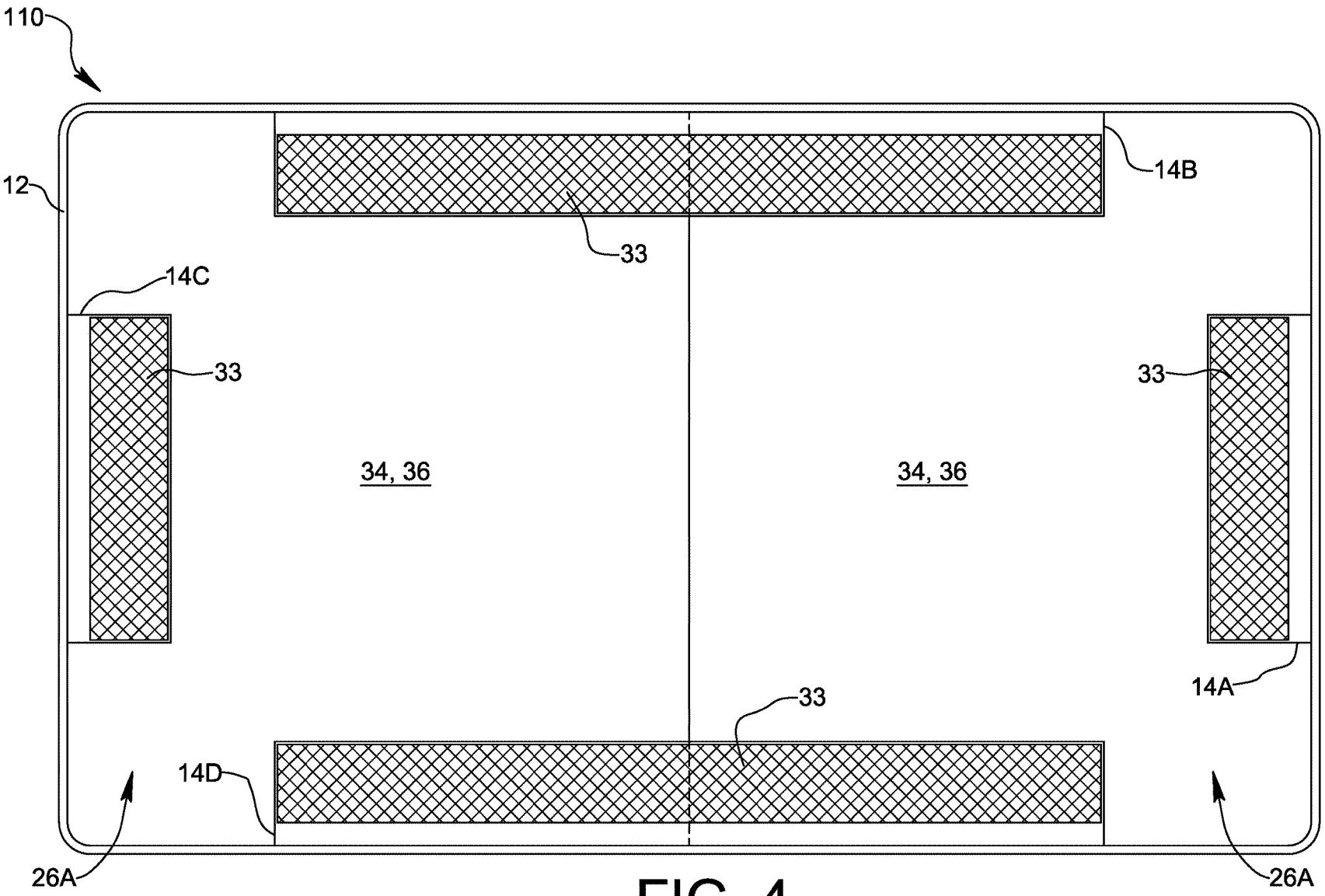
FIG. 4 is a top plan view of similar to that of FIG. 3, illustrating a mattress system formed in accordance with a second embodiment of the present disclosure.

FIG. 4 is a top plan view similar to that of FIG. 3, illustrating a mattress system 110 formed in accordance with a second embodiment of the present disclosure. Mattress system 110 is largely similar to mattress system 10 of the first embodiment, except that the core assembly 16 of mattress system 110 has exactly two pieces of foam 34, one piece 34 being received at head region 26A of shell interior 26, and the other piece 34 being received at foot region 26C of shell interior 26, wherein the two pieces of foam 34 occupy substantially the entire shell interior 26. As in mattress system 10 of the previous embodiment, the use of multiple foam pieces 34 in mattress system 110 is advantageous for shipping and for customization of firmness distribution over the length of mattress system 110 from head to foot. For example, the foam piece 34 at head region 26A may have more firmness or less firmness, as may be desired, relative to the foam piece 34 at foot region 26C.

In mattress system 110, head securement flap 14A folds downward for releasable fastening of its first fastening element 31 to core envelope 36 on foam piece 34 at head region 26A, and foot securement flap 14C folds downward for releasable fastening of its first fastening element 31 to core envelope 36 on foam piece 34 at foot region 26C. Side securement flaps 14B and 14D fold downward for releasable fastening of their associated first fastening elements 31 to core envelopes 36 on foam pieces 34 at head region 26A and foot region 26C. In this embodiment, the core envelope 36 on each foam piece 34 of core assembly 16 is gripped by at least three different first fastener elements 31. The core envelope 36 on the foam piece 34 at head region 26A is gripped by three different first fastener elements 31 on securement flaps 14A, 14B, and 14D, respectively. Similarly, the core envelope 36 on the foam piece 34 at foot region 26C is gripped by three different first fastener elements 31 on securement flaps 14B, 14C, and 14D, respectively. Side securement flaps 14B and 14D may be elongated to overlap both foam pieces 34 of core assembly 16, and their associated first fastener elements 31 may grip the core envelope 36 of each foam piece 34.

Similar to the first embodiment, the second fastener element 33 on the outward side 32 of each of the plurality of securement flaps 14A-14D is releasably fastened to an underside of topper envelope 42 of topper 18. Here again, securement flaps 14A-14D are sandwiched between and attached to core assembly 16 and topper 18, and act to keep topper 18 properly positioned on core assembly 16 during use.

As mentioned above in relation to mattress system 10 of the first embodiment, a variant is possible wherein loop fastener elements (not shown) are attached to each core envelope 36 for mating with first fastener elements 31, and/or loop fastener elements (not shown) are attached to the underside of topper envelope 42 for mating with second fastener elements 33. Where first and second fastener elements 31 and 33 are embodied differently, for example as male snap members, then mating fastener elements, for example female snap members, must be provided on each core envelope 36 and on topper envelope 42 at corresponding locations.

Figure 5:
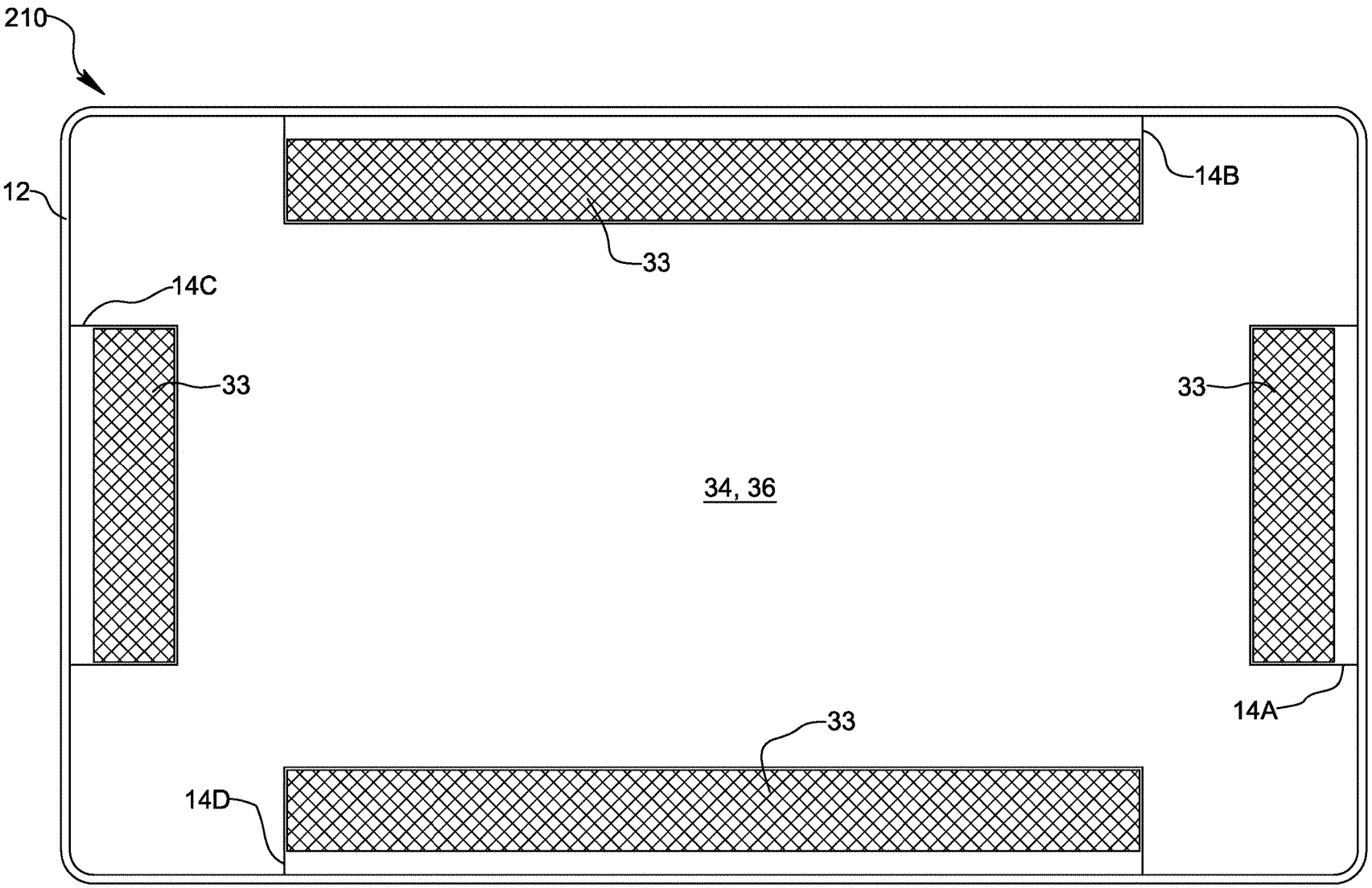
FIG. 5 is a top plan view of similar to that of FIG. 3, illustrating a mattress system formed in accordance with a third embodiment of the present disclosure.
Figure 6:
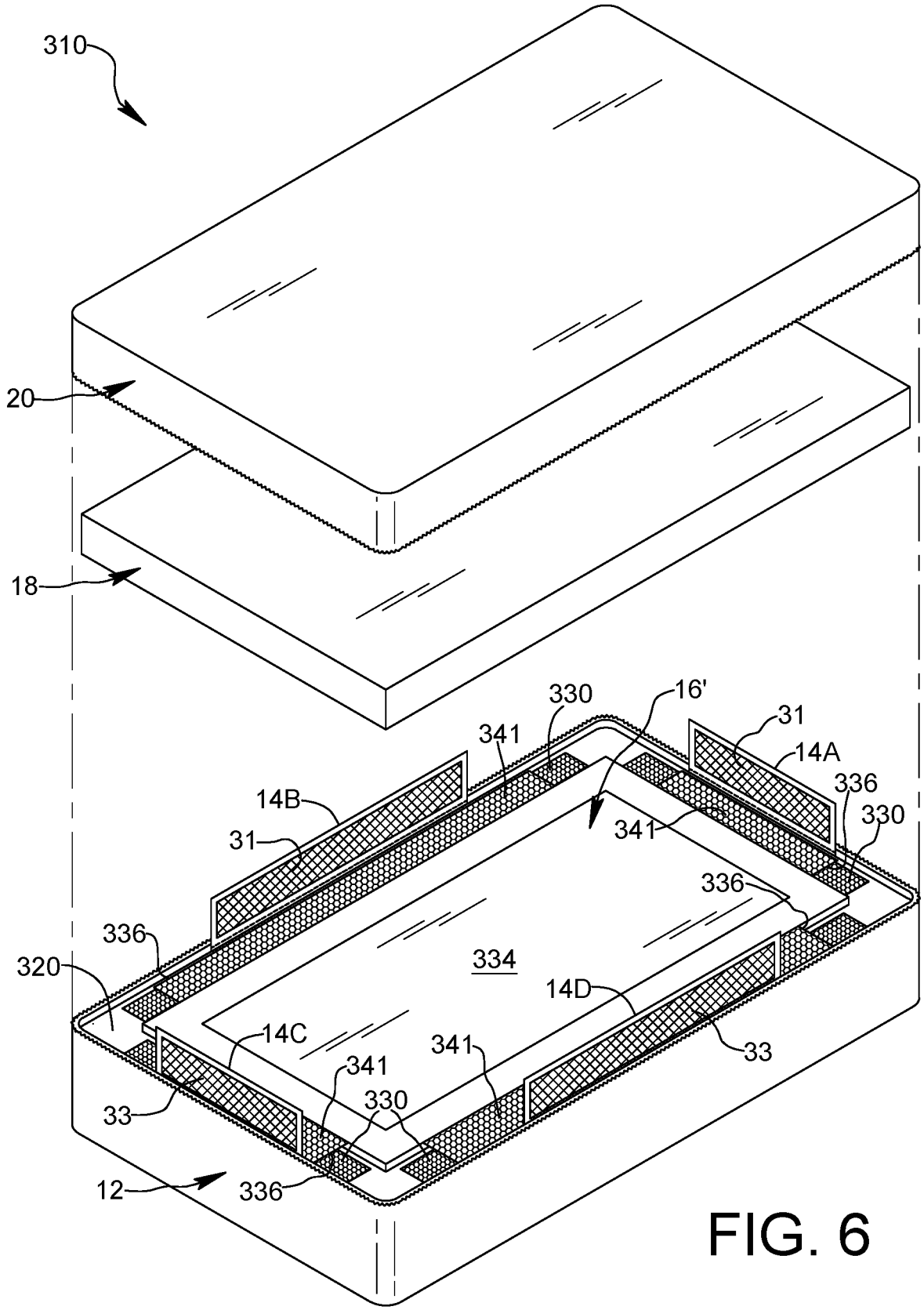
FIG. 6 is a partially exploded orthogonal view of a mattress system formed in accordance with a fourth embodiment of the present disclosure.

FIG. 5 is a top plan view of similar to those of FIG. 3 and FIG. 4, illustrating a mattress system 210 formed in accordance with a third embodiment of the present disclosure. Mattress system 210 is largely similar to mattress systems 10 and 110 of the first and second embodiments, except that the core assembly 16 of mattress system 210 has exactly one piece of foam 34 occupying substantially the entire shell interior 26. In mattress system 210, all securement flaps 14A-14D fold downward for releasable fastening of their associated first fastening elements 31 to core envelope 36 on foam piece 34. In this embodiment, the core envelope 36 on foam piece 34 of core assembly 16 is gripped by at least four different first fastener elements 31. As in the first and second embodiments, the second fastener element 33 on the outward side 32 of each of the plurality of securement flaps 14A-14D is releasably fastened to an underside of topper envelope 42 of topper 18 such that securement flaps 14A-14D are sandwiched between and attached to core assembly 16 and topper 18 to keep topper 18 properly positioned on core assembly 16 during use. Here again, a variant is possible wherein loop fastener elements (not shown) are attached to core envelope 36 for mating with first fastener elements 31, and/or loop fastener elements (not shown) are attached to the underside of topper envelope 42 for mating with second fastener elements 33. Where first and second fastener elements 31 and 33 are embodied differently, for example as male snap members, then mating fastener elements, for example female snap members, must be provided on core envelope 36 and on topper envelope 42 at corresponding locations.

FIGS. 6-8B illustrate a mattress system 310 formed in accordance with a fourth embodiment of the present disclosure. Mattress system 310 is similar to mattress systems 10, 110, and 210 of the previous embodiments in that it includes a shell 12, a plurality of securement flaps 14A-14D, a core assembly 16', a topper 18, and a top cover 20. However, mattress system 310 differs from the mattress systems of the previous embodiments in the configuration of its core assembly 16'.

Figure 8A:
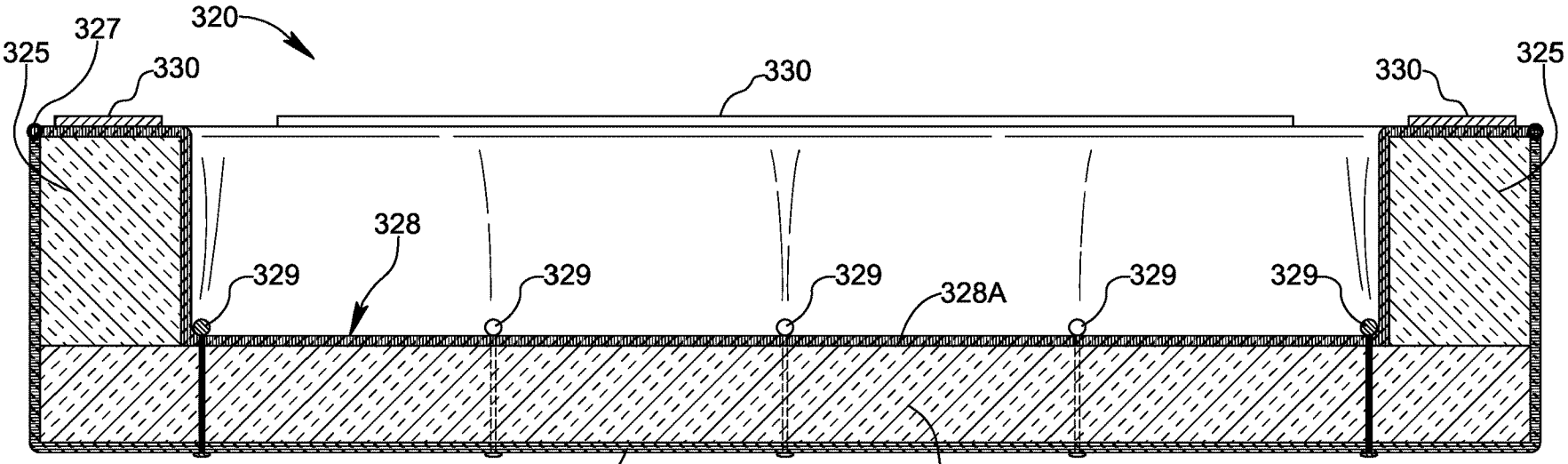
FIG. 8A is a cross-sectional view of a resiliently deformable tub of the core assembly shown in FIG. 7 according to a first variant.
Figure 8B:
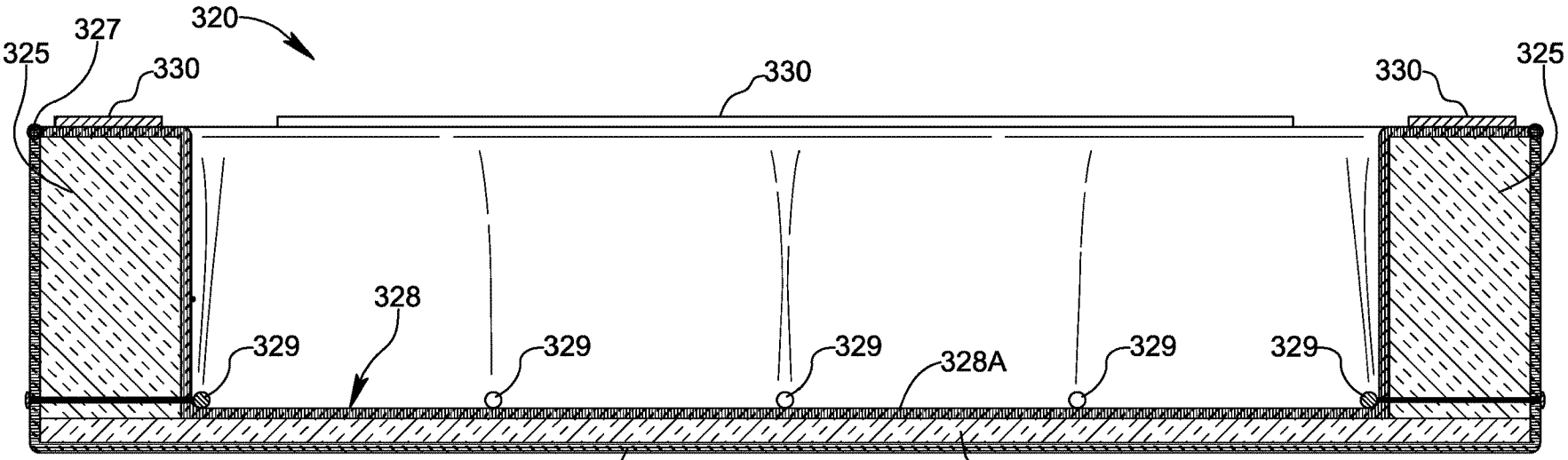
FIG. 8B is a cross-sectional view similar to that of FIG. 8A showing a resiliently deformable tub of the core assembly according to a second variant.

In mattress system 310, core assembly 16' includes a resiliently deformable tub 320. A first variant of resiliently deformable tub 320 is shown in FIG. 8A. Tub 320 has a tub bottom 322 and a peripheral tub wall 324 defining a tub interior 326. Tub 320 may be constructed of foam blocks 323 and 325 having a desired density which are glued together and enclosed within a fabric tub cover 328 to form tub bottom 322 and tub wall 324. Tub cover 328 may have a first cover portion 328A and a second cover portion 328B attached to first cover portion 328A along a peripheral seam 327. First cover portion 328A may be fitted to extend over a top surface and an inner wall surface of foam blocks 325 and an exposed top surface of foam block 323. Second cover portion 328B may be fitted to extend over a bottom surface of foam block 323 and an outer wall surface of foam blocks 325. First cover portion 328A may be coupled with second cover portion 328B by a plurality of tufts 329. In the first variant of tub 320 shown in FIG. 8A, tufts 329 extend vertically through foam block 323 and are arranged at spaced intervals along a peripheral internal edge where foam blocks 325 meet foam block 323. In a second variant of tub 320 offering a deeper tub interior 326 with the same overall external tub dimensions, tufts 329 extend horizontally through foam blocks 325 and are arranged at spaced intervals along the peripheral internal edge where foam blocks 325 meet foam block 323. The second variant allows the use of a thinner foam block 323 that is incompatible with vertical tufts, wherein the height of foam blocks 325 is increased to compensate for reduced thickness (i.e., height) of foam block 323. In both variants, tufts 329 are advantageous to maintain tub cover 328 in proper positional relationship with enclosed foam blocks 323 and 325.

Figure 7:
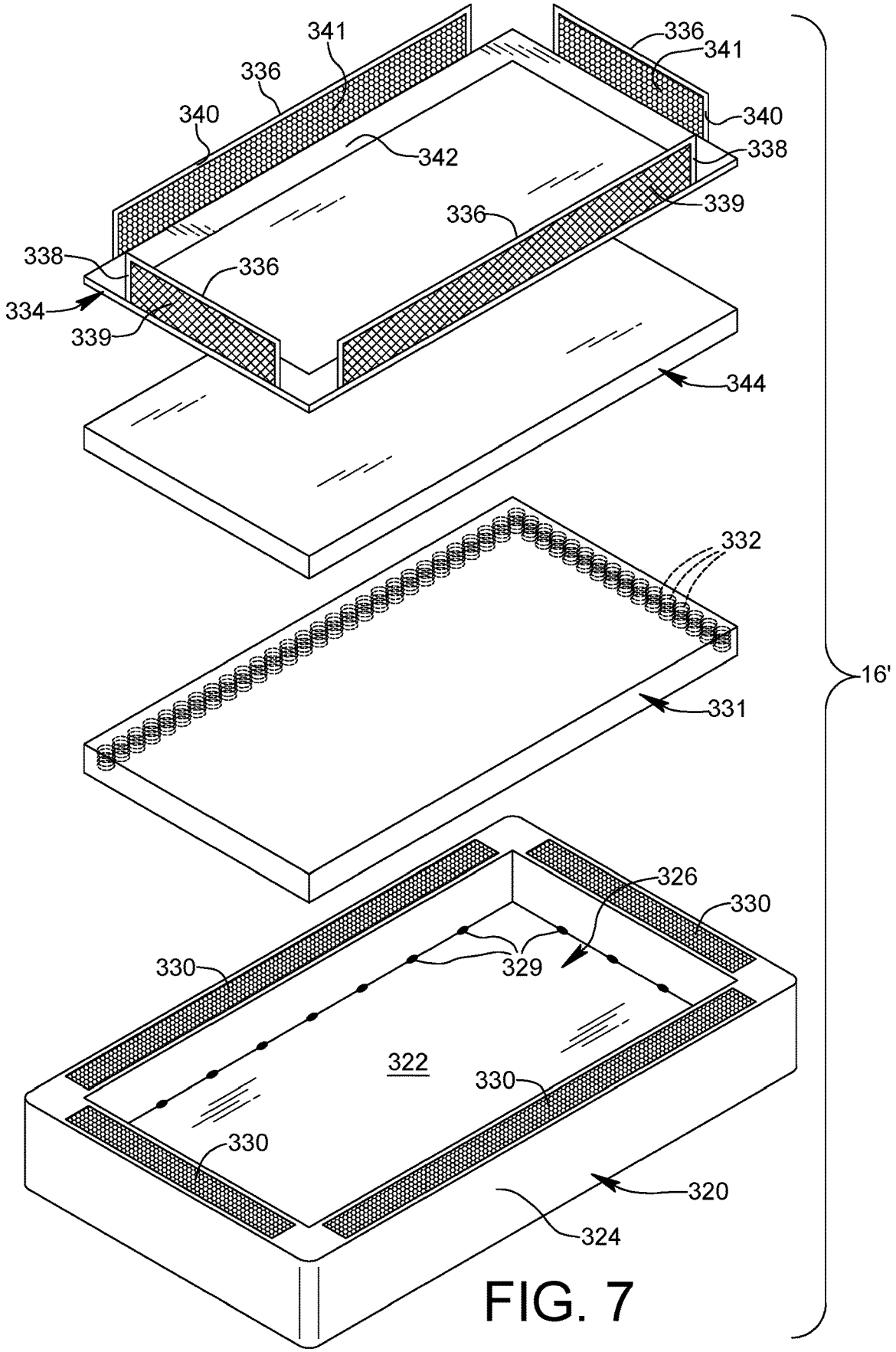
FIG. 7 is an exploded orthogonal view of a resiliently deformable core assembly of the mattress system shown in FIG. 6.

Tub wall 324 may have a plurality of tub wall fastener elements 330 attached to tub cover 328 along a top surface of the tub wall as shown in FIG. 7.

Core assembly 16' of mattress system 310 may further include a base layer 331 received in tub interior 326. Base layer 331 may include an internal array of coil springs 332, for example pocketed coils known in the mattress field. Only some of the coil springs 332 are shown in FIG. 7 for sake of clarity. Base layer 331 is shown as a single unit in FIG. 7, however base layer 331 may include two or more units of smaller area to fill the area footprint of tub interior 326, wherein different units have different coil spring properties to provide varying firmness at different regions of the mattress.

Core assembly 16' may also include a resiliently deformable tub cap 334 arranged above base layer 331 to cover tub interior 326, and a plurality of tub cap flaps 336 attached to tub cap 334. Tub cap 334 may be formed from a layer of foam covered by a fire-resistant fabric sock and sized to fit the opening of tub interior 326. Each of the plurality of tub cap flaps 336 has a downward face 338 and an upward face 340 opposite the downward face, wherein the downward face has one or more tub cap fastener elements 339 thereon and the upward face 340 has one or more securement fastener elements 341 thereon.

Tub cap fastener elements 339 are arranged and configured to mate with tub wall fastener elements 330 when tub cap flaps 336 are extended out horizontally from tub cap 334 such that downward face 338 faces in a downward direction. As a result, tub cap 334 is releasably attachable to tub wall 324 at a position wherein the tub cap covers tub interior 326, and the tub cap may be easily removed to allow access to tub interior 326. Moreover, tub cap 334 and tub cap flaps 336 positively hold tub wall 324 to prevent the tub wall from sagging outward under loading. In one embodiment, tub wall fastener elements 330 are embodied as loop fastener patches and tub cap fastener elements 339 are embodied as hook fastener patches. As may be understood from the foregoing description, variants and gender swapping of mating fastener elements are possible (e.g., using alternative types of fastener elements such as snaps, buttons, zippers, etc., or switching hook patches to loop patches and vice versa).

For enhanced structural integrity of core assembly 16', tub cap flaps 336 may be attached to tub cap 334 by way of a continuous or segmented border 342 of stitch bond fabric glued to the fabric sock and foam layer of tub cap 334, such that tub cap flaps 336 cannot separate or pull away from the tub cap.

Core assembly 16' of mattress system 310 may also include a resiliently deformable intermediate layer 344 received in tub interior 326 between the base layer 331 and tub cap 334. In one embodiment, intermediate layer 344 may be a layer of foam enclosed in a fire-resistant fabric sock.

Figure 9:
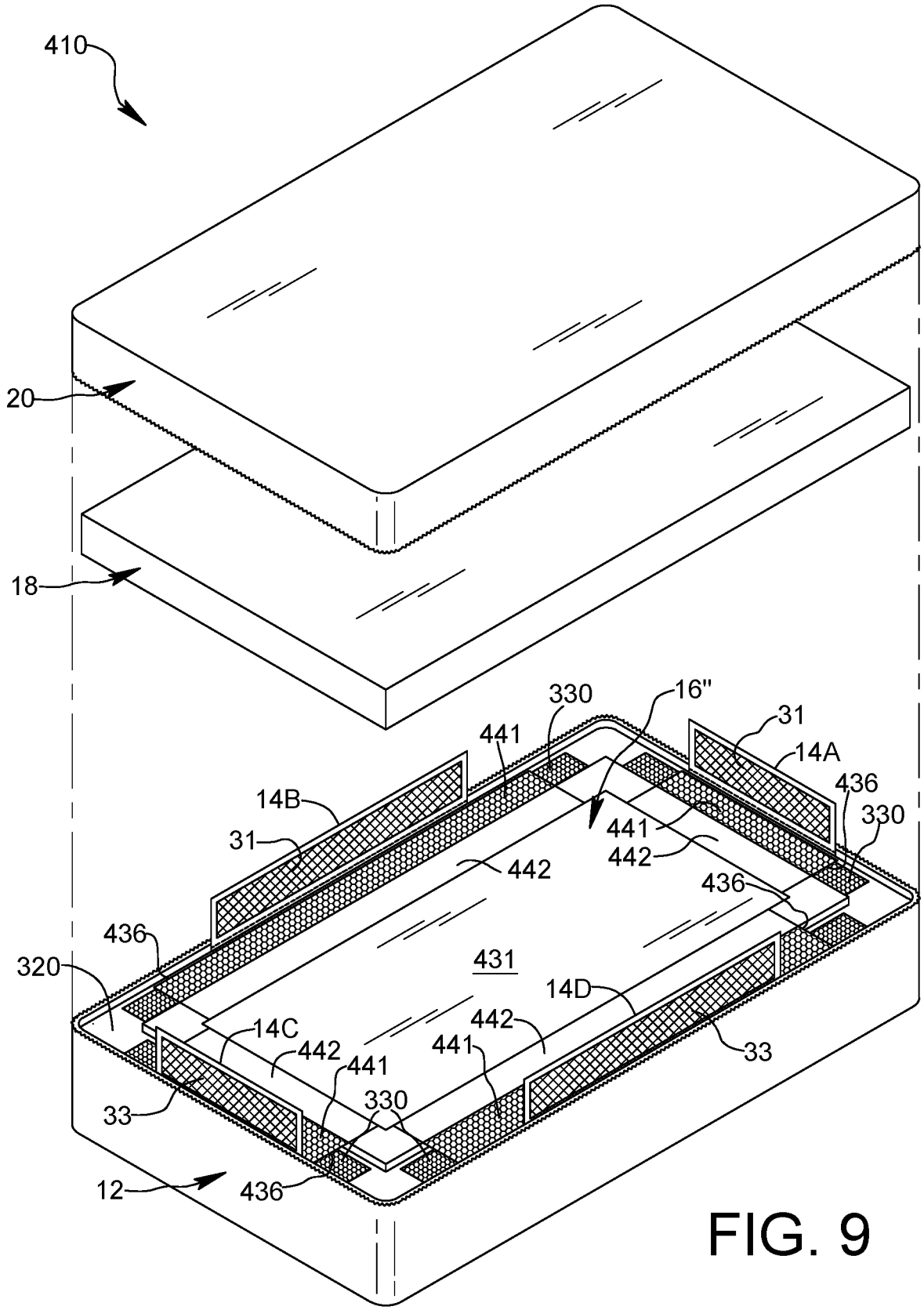
FIG. 9 is a partially exploded orthogonal view of a mattress system formed in accordance with a fifth embodiment of the present disclosure.
Figure 10:
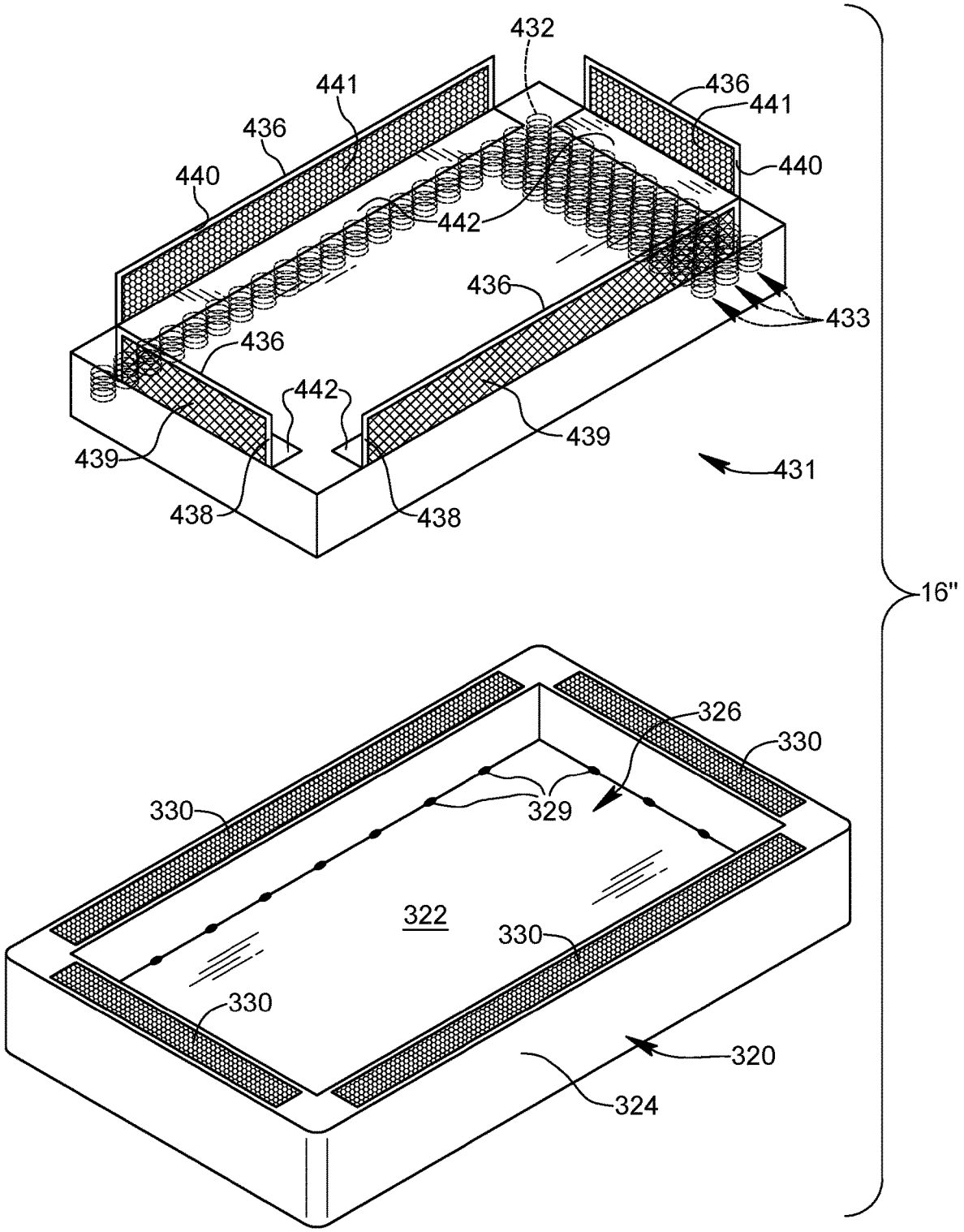
FIG. 10 is an exploded orthogonal view of a resiliently deformable core assembly of the mattress system shown in FIG. 9.
Figure 11:
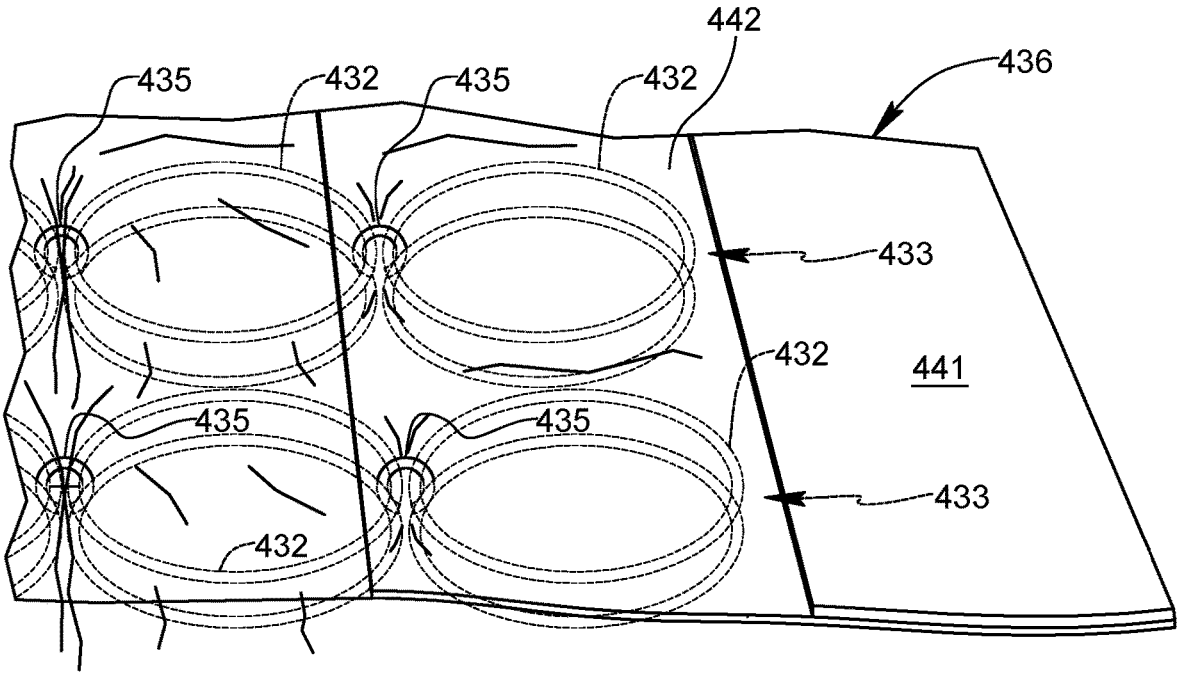
FIG. 11 is a detailed orthogonal view showing a portion if the core assembly shown in FIG. 10.

FIGS. 9-11 illustrate a mattress system 410 formed in accordance with a fifth embodiment of the present disclosure. Mattress system 410 is similar to mattress systems 10, 110, 210 and 310 of the previous embodiments in that it includes a shell 12, a plurality of securement flaps 14A-14D, a core assembly 16", a topper 18, and a top cover 20. However, mattress system 410 differs from the mattress systems of the previous embodiments in the configuration of its core assembly 16".

In mattress system 410, core assembly 16" includes the resiliently deformable tub 320 as described above and shown in FIGS. 6-8. Core assembly 16" of mattress system 410 may further include a core layer 431 received in tub interior 326. Core layer 431 may include an internal array of coil springs 432, for example pocketed coils known in the mattress field. Only some of the coil springs 432 are shown in FIGS. 9-11 for sake of clarity. The internal array of coil springs 432 may be a rectangular array of coil springs having a plurality of rows 433 extending in a width direction of mattress system 410. Core layer 431 is shown as a single unit in FIG. 10, however core layer 431 may include two or more units of smaller area to fill the area footprint of tub interior 326, wherein different units have different coil spring properties to provide varying firmness at different regions of the mattress.

Core layer 431 of core assembly 16" includes a plurality of core layer flaps 436 attached to a top face of core layer 431. Each of the plurality of core layer flaps 436 has a downward face 438 and an upward face 440 opposite the downward face, wherein the downward face has one or more core layer fastener elements 439 thereon and the upward face 440 has one or more securement fastener elements 441 thereon. Core layer fastener elements 439 are arranged and configured to mate with tub wall fastener elements 330 when core layer flaps 436 are extended out horizontally from core layer 431 such that downward face 438 faces in a downward direction. As a result, core layer 431 is releasably attachable to tub wall 324 at a position wherein the core layer 431 occupies tub interior 326 without any substantial gaps, and core layer 431 may be easily removed to allow access to tub interior 326. Core layer 431 and core layer flaps 436 positively hold tub wall 324 to prevent the tub wall from sagging outward under loading. As shown in FIG. 11, the coil springs 432 in each of the plurality of rows 433 may be connected to one another by a plurality of links or C-rings 435 interconnecting adjacent coil springs 432 in the row, further helping to prevent outward sagging of tub wall 324 in a width (i.e., transverse) direction. Alternatively, the array of coil springs 432 may be embodied as a Bonnell spring assembly of interconnected springs linked together by spiral wires. A desirable feature is that core layer 431 is dimensionally stable in the horizontal directions so that core assembly 16" does not sag outward at its opposite sides and/or opposite ends.

In one embodiment, tub wall fastener elements 330 are embodied as loop fastener patches and core layer fastener elements 439 are embodied as hook fastener patches. As may be understood from the foregoing description, variants and gender swapping of mating fastener elements are possible (e.g., using alternative types of fastener elements such as snaps, buttons, zippers, etc., or switching hook patches to loop patches and vice versa).

For enhanced structural integrity of core assembly 16", core layer flaps 436 may be attached to core layer 431 by way of a continuous or segmented border 442 of stitch bond fabric attached to peripherally located coil springs 432 by a plurality of links or C-rings 435 such that core layer flaps 436 cannot separate or pull away from core layer 431. The C-rings 435 used for attachment of border 442 may also be among the C-rings 435 connecting coil springs 432, wherein core layer 431 is arranged in tub interior 326 "link side up" as opposed to link side down.

Mattress systems 10, 110, 210, 310, and 410 of the present disclosure are convenient to ship and move to an intended room in a home or building as unassembled component parts and are easily assembled by an end user without training or tools. Mattress systems 10, 110, 210, 310, and 410 may be reconfigured and/or renewed by removing cover 20 and replacing internal components and/or rearranging internal components.

While the present disclosure describes exemplary embodiments, the detailed description is not intended to limit the scope of the disclosure to the particular forms set forth. The disclosure is intended to cover such alternatives, modifications and equivalents of the described embodiments as may be apparent to one of ordinary skill in the art.

What is claimed is:

1. A mattress system comprising:

a shell including a bottom and a peripheral wall defining a shell interior;

a plurality of securement flaps attached to the peripheral wall, each of the plurality of securement flaps including a free portion extendable over the shell interior, wherein the free portion includes an inward side and an outward side opposite the inward side, wherein the inward side has a first fastener element thereon and the outward side has a second fastener element thereon;

a core assembly removably received in the shell interior;

a topper including one or more foam layers; and a top cover releasably coupled to the shell for covering the shell interior and the topper;

wherein the first fastener element on the inward side of each of the plurality of securement flaps is releasably fastened to the core assembly;

wherein the second fastener element on the outward side of each of the plurality of securement flaps is releasably fastened to the topper.

2. The mattress system according to claim 1, wherein the core assembly includes:

a resiliently deformable tub having a tub bottom and a peripheral tub wall defining a tub interior, the tub wall having a top surface comprising a plurality of tub wall fastener elements thereon;

a core layer received in the tub interior; and a plurality of core layer flaps attached to the core layer, each of the plurality of core layer flaps including a downward face and an upward face opposite the downward face, wherein the downward face has a core layer fastener element thereon and the upward face has a securement fastener element thereon;

wherein the core layer fastener element on each of the plurality of core layer flaps releasably fastens to a respective tub wall fastener element on the top surface of the tub wall.

3. The mattress system according to claim 2, wherein the first fastener element on the inward side of each of the plurality of securement flaps is releasably fastened to the securement fastener element on a respective one of the plurality of core layer flaps.

4. The mattress system according to claim 3, wherein:

the first fastener element on each of the plurality of securement flaps is a hook fastener patch;

the second fastener element on each of the plurality of securement flaps is a hook fastener patch;

the plurality of tub wall fastener elements on the top surface of the tub wall are loop fastener patches;

the core layer fastener element on each of the plurality of core layer flaps is a hook fastener patch; and the securement fastener element on each of the plurality of core layer flaps is a loop fastener patch.

5. The mattress system according to claim 2, wherein the core layer of the core assembly includes a plurality of coil springs.

6. The mattress system according to claim 5, wherein the plurality of coil springs includes a rectangular array of coil springs having a plurality of rows extending in a width direction of the mattress system, wherein the coil springs in each of the plurality of rows are connected to one another by a plurality of links interconnecting adjacent coil springs in the row.

7. The mattress system according to claim 5, wherein the plurality of core layer flaps are attached the core layer by a border of stitch bond fabric attached to peripheral coil springs of the plurality of coil springs by a plurality of links.

8. The mattress system according to claim 2, wherein the tub bottom and the peripheral tub wall are made of foam, and the tub further includes a fabric tub cover over the tub bottom and the peripheral tub wall, wherein the tub cover is attached to the tub bottom or the peripheral tub wall by tufting.

9. The mattress system according to claim 1, wherein the core assembly includes:

a resiliently deformable tub having a tub bottom and a peripheral tub wall defining a tub interior, the tub wall having a top surface comprising a plurality of tub wall fastener elements thereon;

a base layer received in the tub interior;

a resiliently deformable tub cap arranged above the base layer to cover the tub interior; and a plurality of tub cap flaps attached to the tub cap, each of the plurality of tub cap flaps including a downward face and an upward face opposite the downward face, wherein the downward face has a tub cap fastener element thereon and the upward face has a securement fastener element thereon;

wherein the tub cap fastener element on each of the plurality of tub cap flaps releasably fastens to a respective tub wall fastener element on the top surface of the tub wall.

10. The mattress system according to claim 9, wherein the first fastener element on the inward side of each of the plurality of securement flaps is releasably fastened to the securement fastener element on a respective one of the plurality of tub cap flaps.

11. The mattress system according to claim 10, wherein:

the first fastener element on each of the plurality of securement flaps is a hook fastener patch;

the second fastener element on each of the plurality of securement flaps is a hook fastener patch;

the plurality of tub wall fastener elements on the top surface of the tub wall are loop fastener patches;

the tub cap fastener element on each of the plurality of tub cap flaps is a hook fastener patch; and the securement fastener element on each of the plurality of tub cap flaps is a loop fastener patch.

12. The mattress system according to claim 9, wherein the base layer of the core assembly includes a plurality of coil springs.

13. The mattress system according to claim 9, wherein the core assembly further includes a resiliently deformable intermediate layer received in the tub interior between the base layer and the tub cap.

14. The mattress system according to claim 9, wherein the tub bottom and the peripheral tub wall are made of foam, and the tub further includes a fabric tub cover over the tub bottom and the peripheral tub wall, wherein the tub cover is attached to the tub bottom or the peripheral tub wall by tufting.

15. The mattress system according to claim 1, wherein the core assembly includes one or more pieces of foam, each piece of foam being individually enclosed in a respective core envelope of fire-resistant fabric, and the first fastener element on the inward side of each of the plurality of securement flaps is releasably fastened to the core envelope of at least one piece of foam of the core assembly.

16. The mattress system according to claim 15, wherein the core assembly includes exactly two pieces of foam, a first piece of the two pieces of foam being received at head region of the shell interior, and a second piece of the two pieces of foam being received at a foot region of the shell interior.

17. The mattress system according to claim 16, wherein:

the peripheral wall of the shell includes a head wall portion, a foot wall portion parallel to the head wall portion, and a pair of parallel side wall portions extending between the head wall portion and the foot wall portion; and the plurality of securement flaps includes a head securement flap attached to the head wall portion, a foot securement flap attached to the foot wall portion, and a pair of side securement flaps respectively attached to the pair of side wall portions;

wherein the first fastener element on the inward side of each of the pair of side securement flaps is releasably fastened to the core envelope on the first piece of foam and to the core envelope on the second piece of foam.

18. The mattress system according to claim 16, wherein the core assembly includes exactly three pieces of foam, a first piece of the three pieces of foam being received at a head region of the shell interior, a second piece of the three pieces of foam being received at a foot region of the shell interior, and a third piece of the three pieces of foam being received at a middle region of the shell interior between the head region and the foot region.

19. The mattress system according to claim 18, wherein:

the peripheral wall of the shell includes a head wall portion, a foot wall portion parallel to the head wall portion, and a pair of parallel side wall portions extending between the head wall portion and the foot wall portion; and the plurality of securement flaps includes a head securement flap attached to the head wall portion, a foot securement flap attached to the foot wall portion, and a pair of side securement flaps respectively attached to the pair of side wall portions;

wherein the first fastener element on the inward side of each of the pair of side securement flaps is releasably fastened to the core envelope on the first piece of foam, to the core envelope on the second piece of foam, and to the core envelope on the third piece of foam.

* * * * *